United States Patent [19]

Mahony

[11] 4,370,646

[45] Jan. 25, 1983

[54] METHOD AND MEANS FOR CONTROLLING ELECTRON BEAM IN A RASTER SCAN MONITOR

[75] Inventor: John E. Mahony, Sacramento, Calif.

[73] Assignee: General Electric Company, Rancho Cordova, Calif.

[21] Appl. No.: 203,654

[22] Filed: Nov. 3, 1980

[51] Int. Cl.[3] ..... G09G 1/16

[52] U.S. Cl. ..... 340/722; 73/618; 340/728; 340/747

[58] Field of Search ..... 340/722, 728, 747

[56] References Cited

U.S. PATENT DOCUMENTS

| | | | |
|---|---|---|---|
| 3,697,976 | 10/1972 | Fenton | 340/728 |
| 3,878,536 | 4/1975 | Gilliam | 340/728 |
| 4,068,310 | 1/1978 | Friauf | 340/722 X |
| 4,231,032 | 10/1980 | Hara et al. | 340/728 X |
| 4,276,563 | 6/1981 | Heitmann et al. | 340/722 X |

*Primary Examiner*—David L. Trafton

*Attorney, Agent, or Firm*—Flehr, Hohbach, Test, Albritton & Herbert

[57] ABSTRACT

In a raster scan display in which electron beam energization during raster line scan is controlled by comparing a raster value to stored magnitude digital data as a raster line is scanned, a control signal for energizing the electron beam includes a lower bandwidth video signal whereby energization of the electron beam can be anticipated. A comparator of the raster line value to stored magnitude digital data generates a pulse which is applied to three serially connected latches. Logic circuitry connected to the latches generates pulses which are applied to digital to analog converter circuitry which generates the video control signal.

5 Claims, 5 Drawing Figures

METHOD AND MEANS FOR CONTROLLING ELECTRON BEAM IN A RASTER SCAN MONITOR

This invention relates generally to raster scan monitors such as used in ultrasonic scanners, and more particularly the invention relates to a method and means for controlling the electron beam in a raster scan monitor.

Ultrasonic scanning systems are known and commercially available for medical diagnostic purposes. See for example U.S. Pat. No. 4,172,386 for "Video A Trace Display System for Ultrasonic Diagnostic System" and U.S. Pat. No. 4,204,433 for "Computerized Ultrasonic Scanner With Technique Select". The commercially available Datason ultrasonic system of General Electric Company provides an A trace display along with both real time and static images on a television display.

Briefly, such systems utilize sound transducers to transmit ultrasonic (e.g. on the order of several megahertz) waves into a patient and to receive echo signals. In one mode of operation, the transducer is attached to a plurality of hinged arms for movement in a single plane, and potentiometers associated with the hinged arms produce signals which identify the transducer in position. Alternatively, a hand held transducer or a linear transducer array can be employed. The echo signals are applied to a variable gain amplifier to adjust the echo signals for attenuation when passing through the patient. The adjusted signals are then passed through an analog to digital conversion and video processing circuitry and thence either to standard converter circuitry for controlling the body scan display or to A trace conversion circuitry for graphically depicting the ultrasonic pulse echo. The echo amplitude is typically graphically represented as the ordinate value, while the echo return time (indicative of body depth) is reproduced on the abscissa. Accordingly, by viewing the A trace one may determine the depth into the body of each discontinuity in the pulse propagation path and the type of media transition.

While an XY oscilloscope has advantages in displaying complex waveforms and for minimizing noise effects, oscilloscopes are expensive and lack the flexibility in displaying alpha numeric data. Thus, raster scan monitors such as television monitors are preferable even though the display of complex waveforms is more difficult to interpret.

One limitation in the use of a raster scan display in known scanning system lies in the Z axis or illumination output. Typically, a single pulse for controlling the electron beam during a raster line scan is generated when the raster line is to be illuminated. Such a pulse has many high frequency components which, if lost, can cause distortion of the video signal.

Accordingly, an object of the present invention is a method of generating a control signal for an electron beam in a raster scan monitor whereby an improved image is displayed.

Another object of the invention is apparatus for controlling an electron beam in a raster scan monitor whereby an electron beam illumination signal can be anticipated.

A feature of the invention is a lower bandwidth video signal for controlling the electron beam used in raster scanning.

Briefly, in a raster scan display system in which electron beam energization during a raster line scan is controlled by comparing a raster line value to stored magnitude digital data as a raster line is scanned, a control signal for energizing the electron beam is derived by the steps of generating a first pulse when the raster line is to be illuminated, providing a second pulse preceding the first pulse, and providing a third pulse succeeding the first pulse. The first, second and third pulses are then applied to digital to analog converter circuitry whereby a control signal is obtained having a peak magnitude in response to the first pulse and a lesser magnitude in response to the second and third pulses. Thus, lower bandwidth control signal is generated.

Apparatus for generating a control signal for energizing an electron beam in accordance with the invention includes comparator means for comparing a raster line value with magnitude digital data stored in memory as the raster is scanned. The comparator means generates a pulse when the electron beam is to be energized. First, second and third serially connected latch circuitry is provided for sequentially receiving the pulse. Means is interconnected with the first and third latch circuitry for generating a second pulse when the first pulse is in either of said latches, and means is provided for generating a third pulse when the first pulse is in the second latch circuitry. Digital to analog circuitry responds to the third pulse and generates an analog signal having a first magnitude in response to the third pulse and having a second magnitude in response to the second pulses, the second magnitude being less than the first magnitude.

The invention, objects, and features of the invention will be more readily apparent from the following detailed description and appended claims when taken with the drawing, in which:

Figure 1:
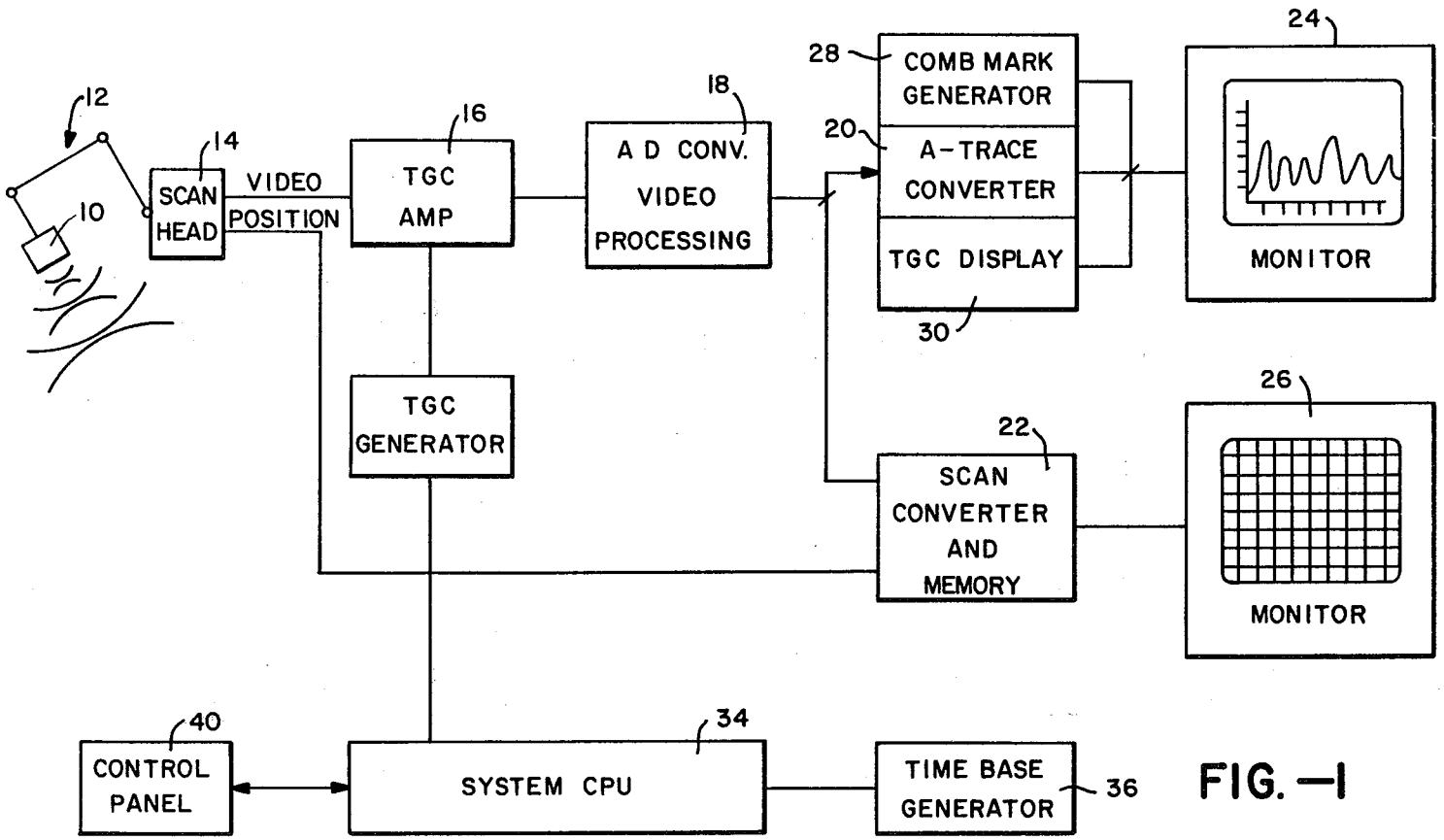
FIG. 1 is a functional block diagram of an ultrasonic scanning system.

Referring now to the drawings, FIG. 1 is a functional block diagram of an ultrasonic scanner. In this embodiment the system includes a transducer 10 mounted on a hinged arm system shown generally at 12 whereby transducer 10 can move freely in a single plane. Potentiometers is scanhead 14 and associated with the arms of the system generate signals indicative of the X and Y position of the scanner 10 in the plane of motion.

Transducer 10 transmits ultrasonic signals (e.g. on the order of 2 megahertz) and generates electrical signals in response to reflections of the transmitted ultrasonic signals. The generated signals are attenuated in time due to attenuation of the ultrasonic signal in passing through a patient.

The attenuated video signal is then applied to a variable gain amplifier 16, and the amplified signal is then applied to analog to digital conversion and video processing circuitry 18. The output of circuitry 18 is then applied to A trace converter circuitry 20 and to scan converter and memory circuitry 22 which generate the signals for controlling television monitors 24 and 26, respectively.

The A trace converter generates a signal for real time display of the amplitude of each reflected ultrasonic wave. The A trace data applied to monitor 24 identifies a horizontal position on the monitor (e.g. 1,000 positions) and an amplitude or vertical position associated with each horizontal position. This data controls the intensity of the electron beam in the display during raster line scanning by the beam. Scale markings for the displayed A trace are generated by comb mark generator 28, and a time gain compensation curve is provided by generator 30.

A section view of the patient is displayed on monitor 26 in response to the scan converter and memory 22. The signal from circuitry 18 is converted for storage in a 512×512 memory matric with each point in the matrix accommodating a 5 bit brightness code. The matrix corresponds to the pixels on the display of monitor 26 with the brightness code being indicative of the Grayscale for the pixels.

System control is provided by a central processing unit 34 which also controls a time base generator 36 which generates the timing signals for the system. A time gain compensation (TGC) control generator 38 generates the control signal for amplifier 16 and a control panel 40 is provided for manual control of the system through the central processing unit.

In a video A trace display system such as described in U.S. Pat. No. 4,172,386, supra, data for controlling the illumination of raster scan lines in the TV display is stored in a memory having a plurality of addresses corresponding to time increments of the raster scan lines of the television display with the data indicating video signal magnitude at each increment. For example, each raster line may be defined by 1,000 addressable positions. The contents of the memory are read out during each line raster scan in the sequence in which they were stored with the data converted to an intensity modulated signal in a format compatible with the raster line scan of the video beam whereby a video display of the A trace is produced.

Figure 2:
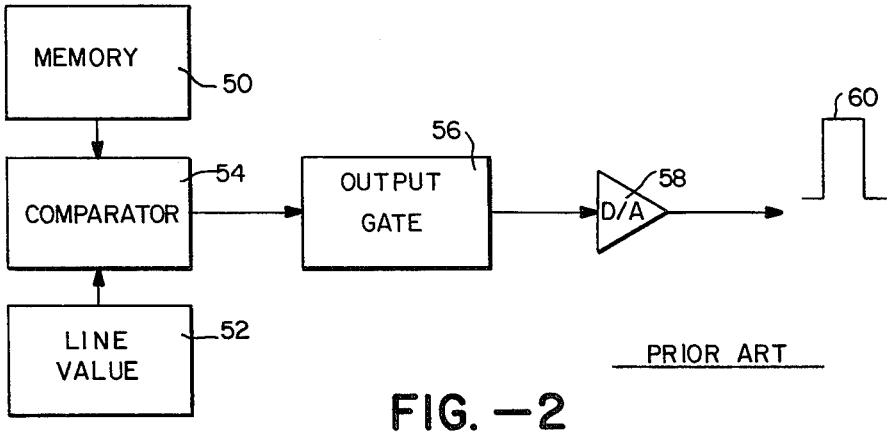
FIG. 2 is a block diagram illustrating a conventional circuitry and control signal for an electron beam.

FIG. 2 illustrates the conventional circuitry in generating the control signal for the electron beam during raster line scanning. The digital data in memory 50 and the line value for the raster being scanned as produced by generator 52 are compared in a comparator 54. The output of the comparator is connected to gating circuitry 56, such as disclosed in copending application Ser. No. 203,653, filed Nov. 3, 1980 for METHOD AND MEANS FOR DISPLAYING COMPLEX WAVES ON A TELEVISION MONITOR, which generates a pulse when the raster line beam scan is to be illuminated. The pulse is then applied to digital to analog converter circuitry 58 which generates an output signal or spike 60 which may be on the order of 50 nanoseconds in width. As above described, such a pulse had considerable high frequency content which if lost would cause distortion in the raster display. This has been a limitation in the video A trace display system disclosed in U.S. Pat. No. 4,172,386.

Figure 3:
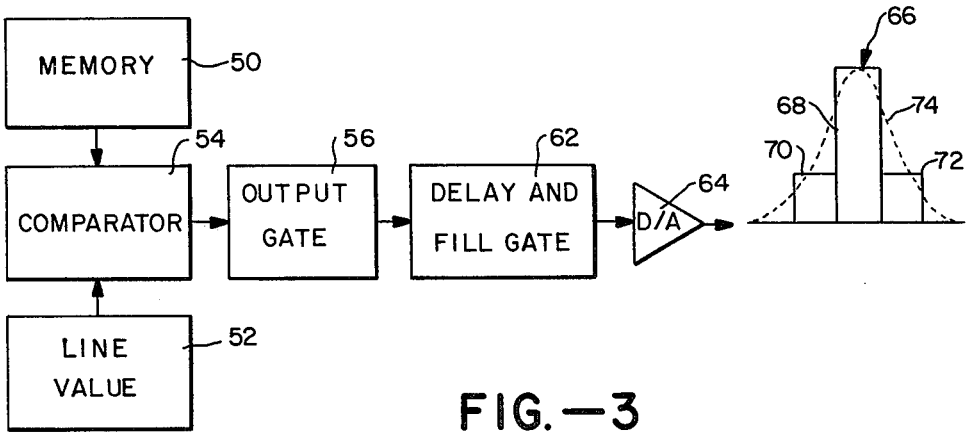
FIG. 3 is a functional block diagram of the circuitry and signal for controlling an electron beam in accordance with the invention.

Referring to FIG. 3, a simple schematic of circuitry in accordance with the present invention is illustrated. In this embodiment the comparator 54 again compares digital data from memory 50 and a line value from gennerator 52 as a raster line is scanned, and the gating circuitry 56 again produces a pulse when the raster line is to be illuminated. However, the pulse from the gating circuitry 56 is applied to delay and fill circuitry 62 which controls the digital to analog converter 64 whereby a control signal 66 is generated. The signal 66 includes a pulse 68 comparable to the pulse 60 in FIG. 2 and pulses 70 and 72 on either side of the pulse 68 and of lesser magnitude than pulse 68. The equivalent band limited signal is shown by dotted line 74. Thus, the main control signal 68 can be anticipated by the control circuitry for the electron beam due to the provision of the pulses 70 and 72.

Figure 4:
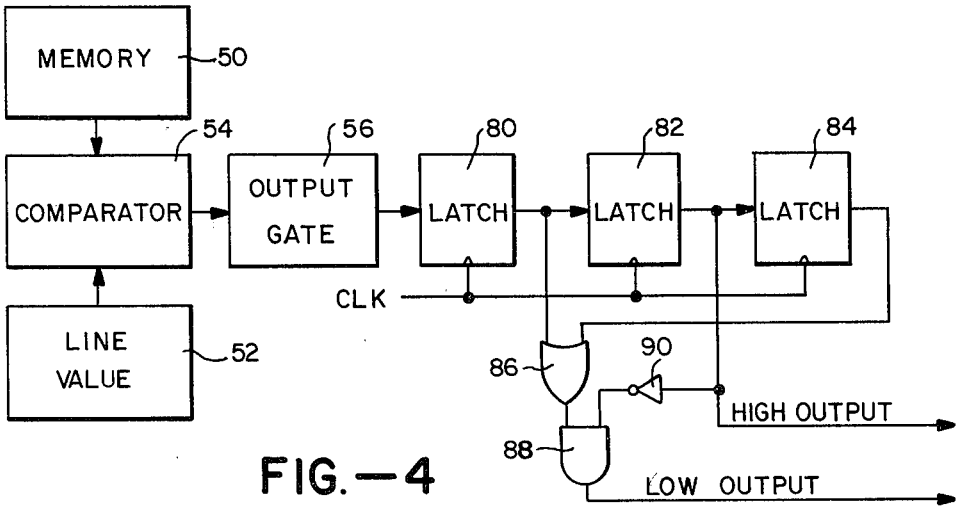
FIG. 4 is a schematic of one embodiment of apparatus for generating a control signal in accordance with the invention.

FIG. 4 is a more detailed schematic of the delay and fill gating circuitry 62 of FIG. 3. Gating circuitry 56 generates a pulse in response to comparator 54 when the raster line is to be illuminated, and the pulse is transmitted through three serially connected latches 82, 82, 84. The output clock controls the latches whereby a pulse from the gate 56 can pass through the three latches 80, 82, 84 during the period of comparison of each digital data word from memory 50. The output of the first latch 80 and the third latch 84 are connected as inputs to OR gate 86, and the output of OR gate 86 is connected to one input of AND gate 88. The output of latch 82 is passed through an inverter 90 as the second input to AND gate 88. AND gate 88 provides an output to the digital to analog converter for generating the side pulses 70 and 72 shown in FIG. 2, and the output taken from latch 82 is applied to the digital to analog converter for generating the larger magnitude pulse 68 shown in FIG. 2. Thus, the gating ensures that the side values provided by pulses 70 and 72 are added only when the larger magnitude pulse 68 is not present.

Figure 5:
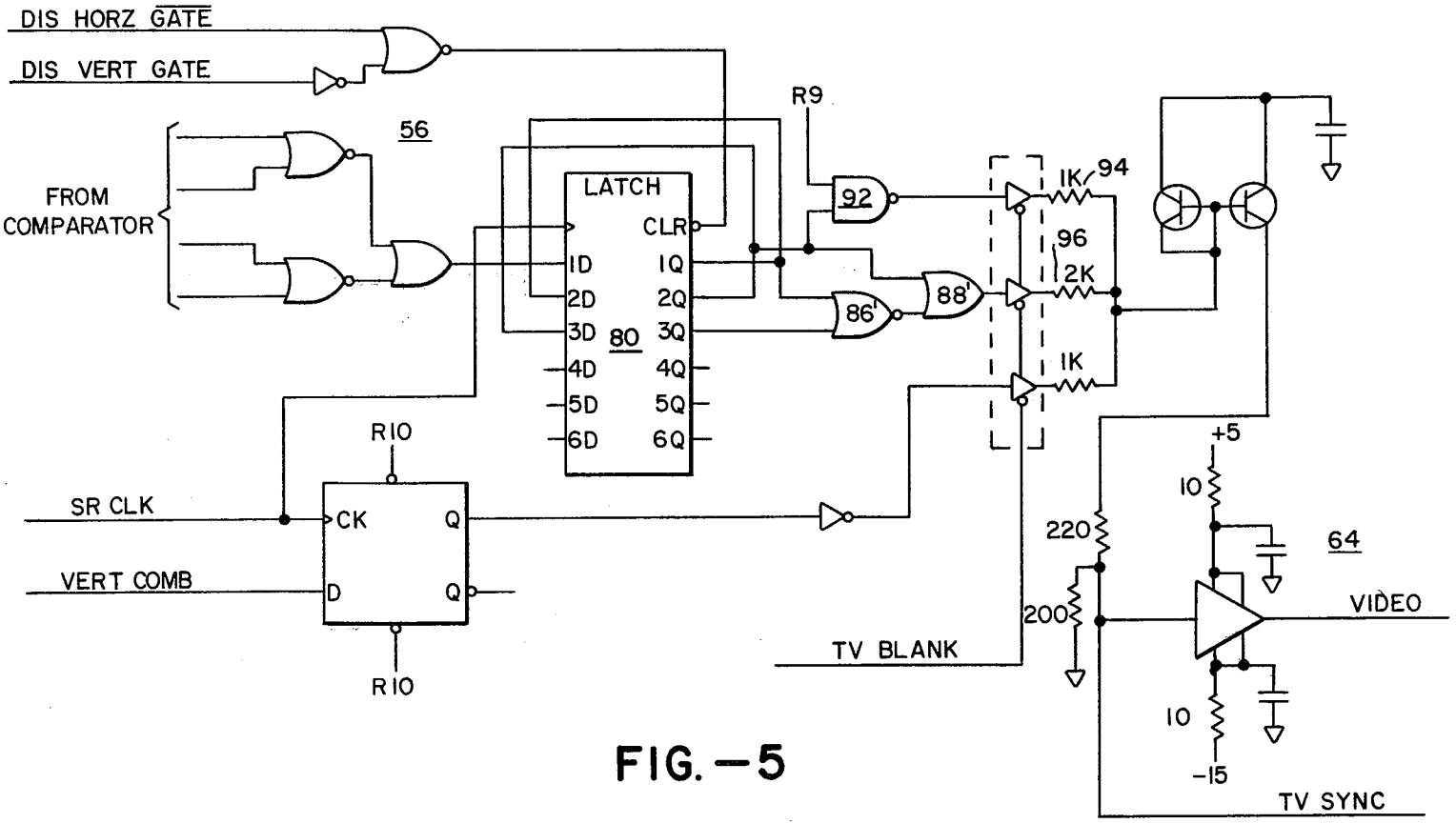
FIG. 5 is a detailed schematic of the circuitry of FIG. 4.

FIG. 5 is a detailed schematic of the circuitry of FIG. 4 as implemented in the Datason system. Like elements have the same reference numerals, and the commercially available products are indicated in parentheses. The gating circuitry 56 responds to inputs from the comparator and generates an output signal when the comparator indicates that the line value is equal to or within a specific range of digital data from memory. The comparator circuitry is illustrated in more detail in co-pending application Ser. No. 203,653, filed Nov. 3, 1980 for METHOD AND MEANS FOR DISPLAYING COMPLEX WAVES ON A TELEVISION MONITOR. The gating circuitry 56 is connected to an input of the serially connected latches 80 (National S174). The inverted outputs from the latches 80 are employed and accordingly a NOR gate 86' and an OR gate 88' are used in place of the OR gate 86 and the AND gate 88 of FIG. 3. The output of the second latch is applied to inverter 92, and the output of the inverter 92 and the output of OR gate 88' are applied through the weighing resistors 94 and 96, respectively, to the digital to analog converter 64.

By providing a control signal which anticipates raster line illumination, in accordance with the invention, an improved display with less distortion is provided in a raster scan monitor. While the invention has been described with reference to a specific embodiment, the description is illustrative of the invention and is not to be construed as limiting the invention. Various modifications and applications may occur to those skilled in the art without departing from the true spirit and scope of the invention as described by the appended claims.

What is claimed is:

1. In a raster scan display system in which electron beam energization during a raster line scan is controlled by comparing a raster line value to stored magnitude digital data as a raster line is scanned, the method of generating a control signal for energizing the electron beam comprising the steps of generating a first pulse when said raster is to be illuminated, generating a second pulse preceding said first pulse, generating a third pulse succeeding said first pulse, and, applying said first, second, and third pulses to digital to analog converter circuitry whereby a control signal is obtained having a peak magnitude in response to said first pulse and a lesser magnitude in response to said second and third pulses.

2. In a raster scan display system, the method of generating a control signal for energizing an electron beam comprising the steps of comparing a raster line value to magnitude digital data as a raster is scanned to determine when said raster line is to be illuminated, generating a first pulse when said raster line is to be illuminated, passing said first pulse through three stages of delay circuitry, generating a second pulse when said first pulse is present in only said first or third stages of said delay circuitry, generating a third pulse when said first pulse is present in said second stage of said delay circuitry, and applying said second pulse to digital to analog converter circuitry for generating an analog output of a first magnitude, and applying said third pulse to said digital to analog circuitry for generating an analog signal having a second magnitude which is greater than said first magnitude whereby the output of said digital to analog converter circuitry controls said electron beam.

3. In a raster scan display system in which electron beam energization during a raster line scan is controlled by comparing a raster value to stored magnitude digital data as a raster line is scanned, apparatus for generating a control signal for energizing the electron beam comprising comparator means for comparing a raster line value with magnitude digital data as a raster is scanned, means for generating a first pulse when said comparator means indicates that the electron beam is to be energized, first, second, and third serially connected latch circuitry for sequentially receiving said first pulse, means for generating a second pulse when said first pulse is in either of said first or third latch circuitry, means for generating a third pulse when said first pulse is in said second latch circuitry, and means responsive to said second pulse for generating an analog signal having a first magnitude and responsive to said third pulse for generating analog signal having a second magnitude greater than said first magnitude whereby said first and second analog signals are applied to control said electron beam.

4. Apparatus as defined by claim 3 and further including means for inhibiting said means for generating a second pulse when said first pulse is in said second latch means.

5. Apparatus as defined by claim 3 wherein said means for generating a second pulse includes an OR gate having a first input connected to said first latch circuitry and a second input connected to said third latch circuitry, an AND gate, a first input of said AND gate connected to the output of said OR gate, an inverter having an input connected to said second latch circuitry and an output connected to a second input to said AND gate whereby said second pulse is generated at the output of said AND gate, and said third pulse is generated at the output of said second latch circuitry.

* * * * *